United States Patent [19]

Tang

[11] Patent Number: 4,772,992

[45] Date of Patent: Sep. 20, 1988

[54] COLLAPSIBLE LAMP SHADE ASSEMBLY, AND METHOD OF USE

[75] Inventor: Yong Tang, Montebello, Calif.

[73] Assignee: Sun Housewares, Inc., Los Angeles, Calif.

[21] Appl. No.: 51,509

[22] Filed: May 14, 1987

[51] Int. Cl.[4] ..... F21V 1/06

[52] U.S. Cl. ..... 362/352; 362/358

[58] Field of Search ..... 362/352, 358, 357

[56] References Cited

U.S. PATENT DOCUMENTS

| | | | |
|---|---|---|---|
| 3,787,676 | 1/1974 | Korach | 362/352 |
| 4,055,760 | 10/1977 | Weisbrod | 362/352 |
| 4,290,099 | 9/1981 | Vicars-Harris | 362/352 |
| 4,383,291 | 5/1983 | Gall | 362/352 |
| 4,539,631 | 9/1985 | Lieberman | 362/358 |
| 4,605,996 | 8/1986 | Payne | 362/352 |
| 4,625,268 | 11/1986 | Payne | 362/352 |
| 4,688,155 | 8/1987 | Huang | 362/358 |

*Primary Examiner*—E. Rollins Cross

*Attorney, Agent, or Firm*—Gene W. Arant

[57] ABSTRACT

A collapsible shade assembly for a lamp includes a shade structure of generally truncated conical configuration having open small and large ends, and having a plurality of clips permanently secured within each of its ends in circumferentially spaced positions therein. Small and large rigid rings fit within corresponding sets of the clips, and are snap-fastened there, for supporting the rings from the shade structure and also causing the rings to hold the shade structure in its normal expanded shape. For purpose of storage or shipment, the rigid rings are removed, and the shade structure with clips appended thereto is rolled into a much smaller volume.

5 Claims, 2 Drawing Sheets

COLLAPSIBLE LAMP SHADE ASSEMBLY, AND METHOD OF USE

BACKGROUND OF THE INVENTION

In the manufacture and distribution of lighting products it has been found that space requirements for storage and transportation of the lighting products have a significant effect upon overall cost.

One such lighting product is the portable lamp, which generally requires a rather bulky lamp shade.

Hence it is desirable to provide lighting products which can be packed into a small space for storage or shipment, even though they may occupy a much larger space when in actual use.

It is therefore the object and purpose of the invention to provide a lamp shade assembly which can be collapsed into a much smaller volume for purpose of transportation or storage.

SUMMARY OF THE INVENTION

According to the invention a flexible shade structure having two open ends is provided with two sets of clips—one at each end—for removably securing rigid rings therein. When the rings are in place the shade structure is in its normal expanded configuration. But for purpose of storage or shipment the rings are removed and the shade structure is rolled up into a much smaller volume.

More specifically, the clips are made of a resilient plastic material with a snap-in portion to receive the associated ring. Each clip occupies only a few degrees of the circumference of the shade structure, and the various clips are spaced circumferentially apart. The clips are economically manufactured as extruded parts, and are then glued inside the shade structure.

In use, the clips are assembled onto the shade structure and the shade structure is then rolled up into a much smaller volume for purpose of storage or shipment. After such storage or shipment, the shade structure is unrolled into its normal shape and the rings are inserted and secured by the respective clip sets so as to permanently hold the shade structure in its operative position.

DRAWING SUMMARY

DETAILED DESCRIPTION

Figure 1:
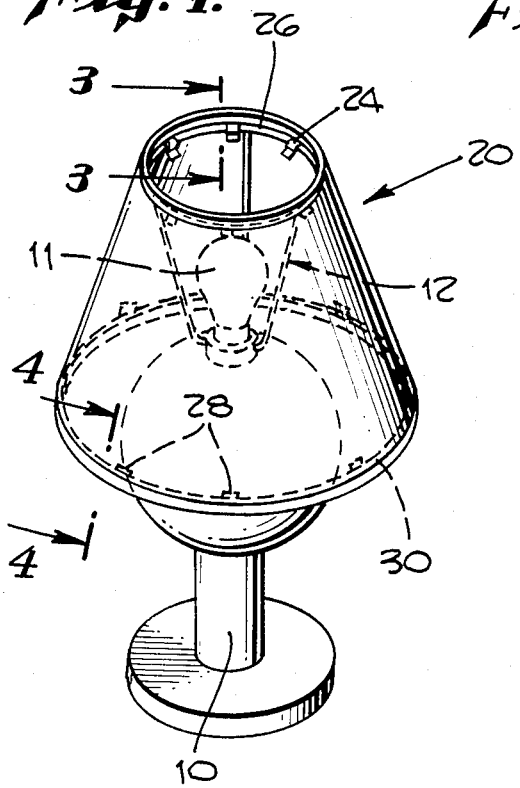
FIG. 1 is a perspective view of a table lamp incorporating the presently preferred form of my novel collapsible lamp shade assembly.

Referring now to the drawings and particularly to FIG. 1, a lamp base 10 supports a single bulb 11 which is shaded by my novel shade assembly 20. The shade assembly is shown in an exploded perspective form in FIG. 2. It includes a flexible shade structure 22 which has two open ends, and more specifically, is normally in the form of a truncated cone having small and large ends.

Within the small or upper end of the shade structure 22 there are a set of clips 24 which are permanently fastened to the shade structure. The clips are spaced circumferentially apart, with each clip occupying only a few degrees of the circumference of the shade. Another part of the shade assembly is the rigid upper ring 26, see FIG. 2.

Figure 3:
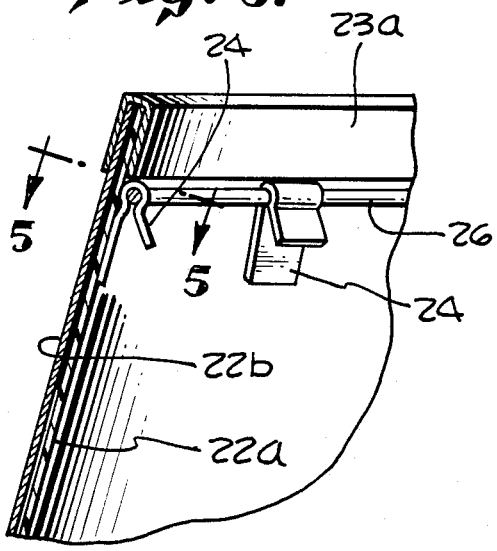
FIG. 3 is a fragmentary cut-away view taken on the line 3—3 of FIG. 1 showing the upper portion of the lamp shade structure.
Figure 5:
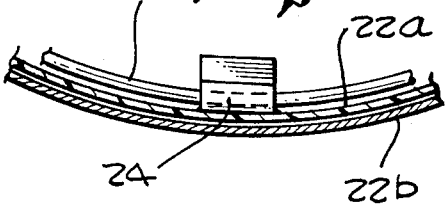
FIG. 5 is an enlarged fragmentary cross-sectional view taken on the line 5—5 of FIG. 3.

Each of the clips 24 has a snap-in part adapted to supporting receive and retain the upper ring 26, as best seen in FIG. 3. With the upper ring 26 thus held in place, the upper portion of the shade maintains its normal expanded configuration.

Figure 4:
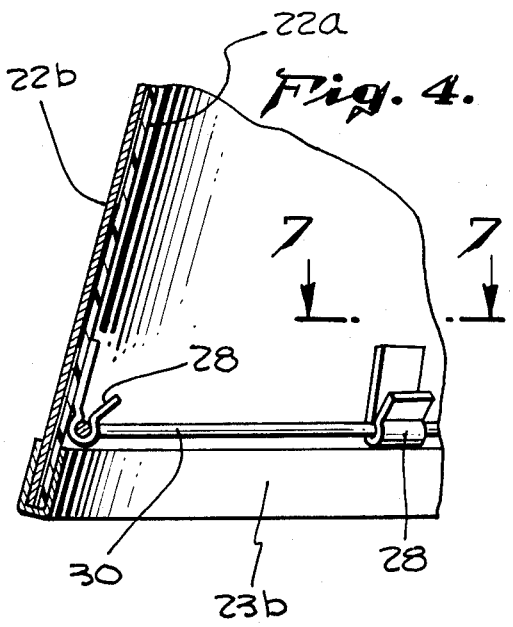
FIG. 4 is a fragmentary cut-away view taken on the line 4—4 of FIG. 1 showing the lower portion of the lamp shade structure.

A further part of the assembly is the lower rigid ring 30. It is adapted to be held in a snap-in supporting relation by a set of clips 28—see FIG. 4—which are secured inside the lower open end of the shade structure 22. Thus with both rigid rings in place the shade structure is reliably held in its normal expanded shape, as illustrated in FIG. 1.

Figure 2:
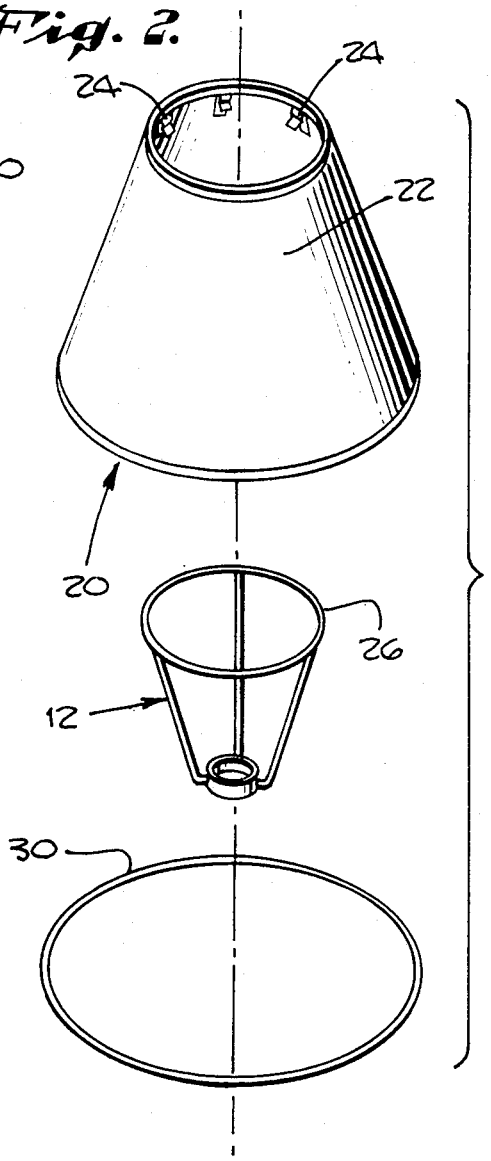
FIG. 2 is an exploded perspective view of the lamp shade assembly of FIG. 1.

The ring 26 as shown in FIG. 2 has secured to it a tripod strucure 12 that cooperates with the lamp base 10 in an entirely conventional and well known manner. It will be understood that the ring 26 is not necessarily attached to such a triood structure, however.

In the particular embodiment of the invention shown in FIGS. 1–7 the shade structure 22 includes an inner member **22*a* and an outer member 22*b*. The inner member 22*a* is preferably made of styrene sheet material, overlapped upon itself at one circumferential location, not specifically shown. Outer member 22*b* is made from a pleated cloth material. The members 22*a* and 22*b*** are secured together by means of gluing at a number of different locations, not specifically shown.

In order to hide the juncture of the inner and outer members **22*a*, 22*b* from view, a cloth band 23*a* is placed over their upper edges, see FIG. 3. A similar cloth band 23*b* is placed under their lower edges, see FIG. 4**.

The clips 24 and the clips 28 are preferably identical. They are preferably made of styrene material for easier gluing to the styrene inner liner **22*a*. In manufacturing the clips 24, 28 it is advantageous to form them from a single continuous extrusion. This is possible because, as clearly shown in the side views of FIGS. 3 and 4**, the side profile of the clips is a hook having one end bent over and then flared outwardly, with the inner dimension of the hook being reduced at the point where the outward flare commences, in order to provide the snap-in part for retaining the corresponding one of the rigid rings.

While in the presently preferred embodiment the rings 26 and 30 are shown as being made of metal, these rings may if desired be made of some other rigid material, such as a rigid plastic.

Figure 8:
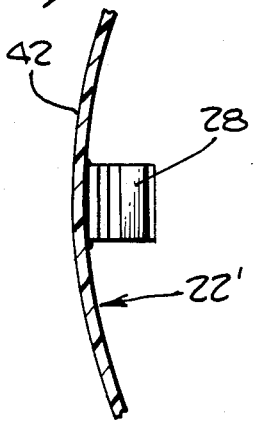
FIG. 8 is a cross-sectional view like FIG. 7, but showing a modified form of the shade structure.
Figure 6:
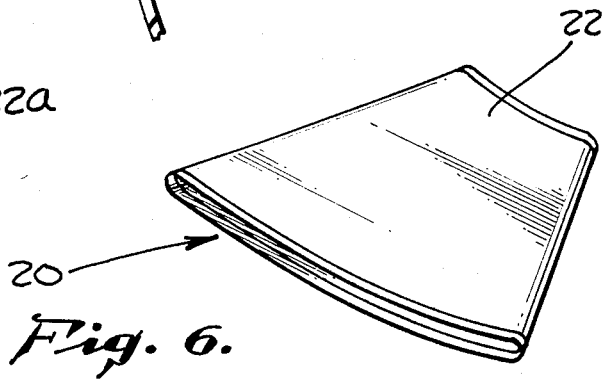
FIG. 6 is a perspective view of the shade structure of FIG. 1 in a collapsed form.

FIG. 8 shows a modified form of shade structure 22' which utilizes a single panel 42 of flexible plastic, cardboard, or other material. The clips 28 are glued to it directly.

Figure 9:
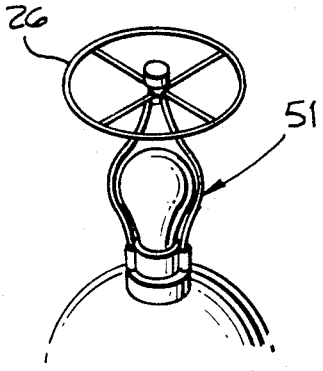
FIG. 9 shows another type of lamp mechanism in which my new collapsible shade assembly is used.
Figure 10:
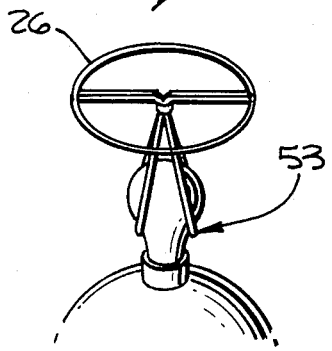
FIG. 10 shows still another type of lamp mechanism which incorporates my new collapsible shade assembly.
Figure 7:
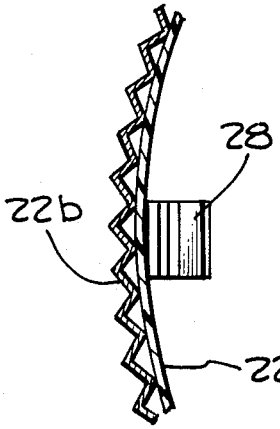
FIG. 7 is a fragmentary cross-sectional view of the shade structure taken on line 7—7 of FIG. 4.

FIGS. 9 and 10 show frame structures 51 and 53 which may if desired be used in conjunction with the upper ring 26 in lieu of the tripod 12.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What I claim is:

1. A collapsible lamp shade assembly comprising, in combination:

a flexible shade structure normally in the form of a truncated cone having small and large ends;

first and second rigid rings, said first ring being adapted to fit within said small end of said shade structure, and said second ring being adapted to fit within said large end of said shade structure;

a first plurality of plastic clips glued within said small end of said shade structure in circumferentially spaced positions therein, and adapted to removably receive said first ring in snap-fitting relation therewith;

a second plurality of plastic clips glued within said large end of said shade structure in circumferentially spaced positions therein, and adapted to removably receive said second ring in snap-fitting relation therewith; and said shade structure with clips thereon being adapted to be rolled up into a much smaller volume for storage or transportation purposes.

2. The shade assembly of claim 1 wherein each of said clips occupies only a few degrees of the shade structure, the clips being formed by extrusion and being then glued to the shade structure.

3. The shade assembly of claim 1 wherein said shade structure has inner and outer members, said inner member being made of a styrene sheet material and said outer member being made of pleated cloth.

4. The shade assembly of claim 3 wherein said shade structure additionally includes upper and lower cloth bands, respectively, covering the edges of said inner and outer members.

5. The shade assembly of claim 3 wherein each of said clips is made of a resilient plastic material, has an elongated base part gluded to said inner sheet member, and has a hook with one end that is bent over and then flared outwardly, its inner dimension being reduced at the point where the outward flare commences.

* * * * *